US009837086B2

(12) United States Patent
Baumgarte

(10) Patent No.: US 9,837,086 B2
(45) Date of Patent: Dec. 5, 2017

(54) ENCODED AUDIO EXTENDED METADATA-BASED DYNAMIC RANGE CONTROL

(71) Applicant: Apple Inc., Cupertino, CA (US)

(72) Inventor: Frank Baumgarte, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/217,632

(22) Filed: Jul. 22, 2016

(65) Prior Publication Data

US 2017/0032793 A1 Feb. 2, 2017

Related U.S. Application Data

(60) Provisional application No. 62/199,819, filed on Jul. 31, 2015.

(51) Int. Cl.

| | |
|---|---|
| ***H04R 5/00*** | (2006.01) |
| ***G10L 19/008*** | (2013.01) |
| ***H04S 3/00*** | (2006.01) |

(52) U.S. Cl.

CPC ..... *G10L 19/008* (2013.01); *H04S 3/008* (2013.01); *H04S 2400/13* (2013.01); *H04S 2400/15* (2013.01); *H04S 2420/07* (2013.01)

(58) Field of Classification Search

CPC ..... H04R 5/00

See application file for complete search history.

(56) References Cited

U.S. PATENT DOCUMENTS

| | | | |
|---|---|---|---|
| 8,374,361 | B2 | 2/2013 | Moon et al. |
| 8,379,880 | B2 | 2/2013 | Riedl |

(Continued)

FOREIGN PATENT DOCUMENTS

| | | |
|---|---|---|
| WO | WO-2005101959 | 11/2005 |
| WO | WO-2007127023 | 11/2007 |

(Continued)

OTHER PUBLICATIONS

Korean Office Action with English Language Translation, dated Aug. 25, 2016, Korean Application No. 10-2015-7026825.

(Continued)

*Primary Examiner* — Olisa Anwah

(74) *Attorney, Agent, or Firm* — Blakely Sokoloff Taylor & Zafman LLP

(57) ABSTRACT

An audio encoder encodes a digital audio recording having a number of audio channels or audio objects. A Dynamic Range Control (DRC) processor produces a sequence of encoder DRC gain values, by applying a selected one of a number of DRC characteristics to a group of one or more of the audio channels or audio objects. The encoder DRC gain values are to be applied to adjust the group of audio channels or audio objects, upon decoding them from the encoded digital audio recording. A bitstream multiplexer combines a) the encoded digital audio recording with b) the sequence of encoder DRC gain values, an indication of the selected DRC characteristic, and an indication of an alternate DRC characteristic, the latter as metadata associated with the encoded digital audio recording. Other embodiments are also described including a system for decoding the encoded audio recording and performing DRC adjustment upon it.

21 Claims, 4 Drawing Sheets

(56) References Cited

U.S. PATENT DOCUMENTS

| | | | | |
|---|---|---|---|---|
| 8,488,809 | B2 | 7/2013 | Seefeldt | |
| 8,824,688 | B2 | 9/2014 | Schreiner et al. | |
| 8,903,729 | B2 | 12/2014 | Riedmiller et al. | |
| 2006/0002572 | A1 | 1/2006 | Smithers et al. | |
| 2008/0271079 | A1 | 10/2008 | Yoon et al. | |
| 2009/0063159 | A1* | 3/2009 | Crockett | G10L 19/167 704/500 |
| 2010/0109926 | A1* | 5/2010 | Medina | G11B 27/034 341/144 |
| 2010/0263002 | A1 | 10/2010 | Meuninck et al. | |
| 2011/0038490 | A1 | 2/2011 | Yang et al. | |
| 2012/0016680 | A1* | 1/2012 | Thesing | G10L 19/008 704/500 |
| 2012/0243692 | A1* | 9/2012 | Ramamoorthy | G10L 19/0212 381/22 |
| 2012/0310654 | A1 | 12/2012 | Riedmiller et al. | |
| 2014/0044268 | A1 | 2/2014 | Herberger et al. | |
| 2014/0294200 | A1 | 10/2014 | Baumgarte et al. | |
| 2014/0297291 | A1 | 10/2014 | Baumgarte | |
| 2015/0036842 | A1* | 2/2015 | Robinson | G06F 3/165 381/103 |
| 2015/0223002 | A1* | 8/2015 | Mehta | H04S 7/30 381/303 |
| 2016/0197590 | A1* | 7/2016 | Koppens | H03G 7/007 381/106 |
| 2016/0211817 | A1* | 7/2016 | Krishnaswamy | H03G 3/02 |
| 2016/0219391 | A1* | 7/2016 | Ward | G10L 19/008 |
| 2016/0227339 | A1* | 8/2016 | Koppens | H03G 7/007 |
| 2016/0266865 | A1* | 9/2016 | Tsingos | H04S 7/304 |
| 2016/0322061 | A1* | 11/2016 | Riedmiller | G10L 19/008 |
| 2017/0206912 | A1* | 7/2017 | Grant | G10L 19/002 |

FOREIGN PATENT DOCUMENTS

| | | |
|---|---|---|
| WO | WO-2013102799 A1 | 7/2013 |
| WO | WO-2014113471 | 7/2014 |
| WO | WO-2014114781 | 7/2014 |
| WO | WO-2014160895 | 10/2014 |

OTHER PUBLICATIONS

European Office Action, dated Sep. 14, 2016, European Application No. 14724887.6.

"Algorithm to measure audio programme loudness and true-peak audio level", *Recommendation ITU-R BS.1770*, (2006), 1-19.

U.S. Notice of Allowance, dated Oct. 13, 2016, U.S. Appl. No. 14/225,950.

International Search Report and Written Opinion, dated Nov. 10, 2016, Application No. PCT/US2016/043932.

"Digital Video Broadcasting (DVB); Specification for the use of Video and Audio Coding in Broadcasting Applications based on the MPEG-2 Transport Stream", *ETSI Draft; 00V1111, European Telecommunications Standards Institute*, No. V1.11.1, (Jul. 24, 2007), 1-194.

International Preliminary Report on Patentability and Written Opinion, dated Oct. 8 2015 Application No. PCT/US2014/031992.

Taiwan Office Action (dated Oct. 26, 2015) ROC (Taiwan) Pat App No. 103111835. Date App Filed: Mar. 28, 2014, 7.

Non-Final Office Action (dated Feb. 4, 2016) U.S. Appl. No. 14/225,950, filed Mar. 26, 2014, First Named Inventor: Frank Baumgarte, 22.

Australian Patent Examination Report No. 1 (dated Jun. 14, 2016), Patent App No. 2014241222, Filing date: Mar. 27, 2014, 3 pages.

PCT International Search Report and Written Opinion (dated Oct. 7, 2014), International Application No. PCT/US2014/031992, International Filing Date—Mar. 27, 2014, 13 pages.

"A guide to Dolby Metadata", Jan. 1, 2005, Issue 3, XP055102178, Retrieved from Internet: URL: http://www.dolby.com/uploadedFiles/Assets/US/Doc/Professional/18_Metadata.Guide.pdf [retrieved on Feb. 14, 2014], 28 pages.

"A/53: ATSC Digital Television Standard, Parts 1-6, 2007", Jan. 3, 2007, *Advanced Television Systems Committee, Inc.*, Washington DC, USA, (Jun. 3, 2007), 136 pages.

"Algorithms to Measure Audio Programme Loudness and True-Peak Audio Level", Recommendation ITU-R BS.1770-3 (Aug. 2012), *ITU-R Radiocommunication Sector of ITU, BS Series Broadcasting Service* (*sound*), 24 pages.

"ATSC Recommended Practice: Techniques for Establishing and Maintaining Audio Loudness for Digital Television", Document A/85:2011, Jul. 25, 2011, *Advanced Television Systems Committee, Inc.*, Washington, DC, USA, 77 pages.

"ATSC Standard: Digital Audio Compression (AC-3, E-AC-3)", Doc. A/52:2012, Dec. 17, 2012, *ATSC Advanced Television Systems Committee*, Washington, DC, USA, 270 pages.

"Declaring an end to the loudness wars", Internet document at: http://www.barrydiamentaudio.com/loudness.htm, Admitted Prior Art, 9 pages.

"Digital Video Broadcasting (DVB); Specification for the use of Video and Audio Coding in Broadcasting Applications based on the MPEG-2 Transport Stream", Technical Specification, ETSI TS 101 154 V1.11.1 (Nov. 2012), *EBU Operating Eurovision, DVB Digital Video Broadcasting*, 195 pages.

"International Standard ISO/IEC 14496-3,", *Fourth Edition 200X-XX-XX, Information technology—Coding of audio-visual objects—Part 3: Audio*, Reference number ISO/IEC 14496-3(E), © ISO/IEC 2009, 15 pages.

"ISO/IEC 14496-3:200X(E)", Content for Subpart 1 (p. 2); Subpart 1: Main (pp. 3-134); and Annex 1.C (pp. 135-136), © ISO/IEC 2001, 135 pages.

"Loudness Normalisation and Permitted Maximum Level of Audio Signals", *Status: EBU Recommendation, EBU—Recommendation R 128*, Geneva, Aug. 2011, 5 pages.

"Recommendation ITU-R BS.1770-1 Algorithms to measure audio programme loudness and true-peak audio level", (Question ITU-R 2/6), Jan. 1, 2006, Geneva, Retrieved from the Internet: URL: http://webs.uvigo.es/servicios/biblioteca/uit/rec/BS/R-REC-BS.1770-1-200709-I]] PDF-E.pdf, [retrieved on May 27, 2011], 19 pages.

"Specification of the Broadcast Wave Format; a format for audio data files", Supplement 6: Dolby Metadata, <dbmd> chunk (Corresponds to Dolby Version: 1.0.0.6), Geneva, Oct. 1, 2009, XP055105526, Retrieved from Internet: URL: https://tech.ebu.ch/docs/tech/tech3285s6.pdf [retrieved on Mar. 5, 2014], 46 pages.

"White Paper HE-AAC Metadata for Digital Broadcasting", *Fraunhofer Institute for Integrated Circuits IIS, © Fraunhofer IIS*, Sep. 2011, 16 pages.

Guttenberg, Steve , "Engineer predicts Apple's iTunes Radio will put an end to overly loud recordings", Oct. 26, 2013, Internet article at: http://news.cnet.com/8301-13645_3_57609317-47/engineer-pred . . . , 17 pages.

Kuech, Fabian , et al., "Dynamic Rang and Loudness Control in MPEG-H 3D Audio", *Audio Engineering Society Convention Paper 9465, Presented at the 139th Convention*. Oct. 29-Nov. 1, 2015, New York, USA., (Oct. 29, 2015), 10 pages.

Rose, Matthias , "Understanding MPEG Audio Codecs From mp3 to xHE-AAC", Jun. 28, 2012, Internet article at: http://electronicdesign.com/print/embeddedunderstanding-mpe . . . , 5 pages.

Singer, David , "Enhanced Audio Support in the ISO Base Media File Format", International Organization for Standardization Organisation Internationale de Normalisation ISO/IEC JTC1/SC29/WG11 Coding of Moving Pictures and Audio, Jan. 15, 2013, Geneva, CH, 12 pages.

* cited by examiner

PROCESSING AT PLAYBACK

ENCODED AUDIO EXTENDED METADATA-BASED DYNAMIC RANGE CONTROL

This application claims the benefit of the earlier filing date of U.S. Provisional Patent Application No. 62/199,819, filed Jul. 31, 2015.

FIELD

An embodiment of the invention pertains generally to the encoding and decoding of an audio signal, and the use of metadata associated with the encoded signal during playback of the decoded signal, to improve quality of playback in various types of consumer electronics end user devices. Other embodiments are also described.

BACKGROUND

Digital audio content appears in many instances, including for example music and movie files. In most instances, an audio signal is encoded for purposes of data-rate reduction or format conversion, so that the transfer or delivery of the media file or stream is more practical, consumes less bandwidth and/or is faster, thereby allowing numerous other transfers to occur simultaneously. The media file or stream can be received in different types of end user devices, where the encoded audio signal is decoded before being presented to the consumer through either built-in or detachable speakers. This has helped fuel consumers' appetite for obtaining digital media over the Internet. Creators and distributers of digital audio content (programs) have several approaches at their disposal, which can be used for encoding and decoding audio content. These include Digital Audio Compression Standard (AC-3, E-AC-3), Revision B, Document A/52B, 14 Jun. 2005 published by the Advanced Television Systems Committee, Inc. (the "ATSC Standard"), European Telecommunication Standards Institute, ETSI TS 101 154 Digital Video Broadcasting (DVB) based on MPEG-2 Transport Stream in ISO/IEC 13818-7, Advanced Audio Coding (AAC) ("MPEG-2 AAC Standard"), and ISO/IEC 14496-3 ("MPEG-4 Audio"), published by the International Standards Organization (ISO).

Audio content may be decoded and then processed (rendered) differently than it was originally mastered. For example, a mastering engineer could record an orchestra or a concert such that upon playback it would sound (to a listener) as if the listener were sitting in the audience of the concert, i.e. in front of the band or orchestra, with the applause being heard from behind. The mastering engineer could alternatively make a different rendering (of the same concert), so that, for example upon playback the listener would hear the concert as if he were on stage (where he would hear the instruments "around him", and the applause "in front"). This is also referred to as creating a different perspective for the listener in the playback room, or rendering the audio content for a different "listening location" or different playback room.

Audio content may also be rendered for different acoustic environments, e.g. playback through a headset, a smartphone speakerphone, or the built-in speakers of a tablet computer, a laptop computer, or a desktop computer. In particular, object based audio playback techniques are now available where an individual digital audio object, which is a digital audio recording of, e.g. a single person talking, an explosion, applause, or background sounds, can be played back differently over any one or more speaker channels in a given acoustic environment.

Dynamic range in the context audio playback refers to a ratio between the loudest and softest sounds (loudness levels) computed from the digital audio content. The loudness level can be computed using any suitable mathematical model, which estimates how sound is perceived (or heard) by humans. Dynamic range control (DRC) refers to approaches for controlling the dynamic range, e.g. compressing it or expanding it, so as to change how loud portions and soft portions of the audio content are heard during playback. Audio engineers apply DRC to a digital audio signal, in order to optimize a particular audio recording for a particular acoustic environment or for a particular listener perspective. For example, a work of modern pop music may have its dynamic range compressed so that it can be played back at a louder level (without clipping), while a piece of classical music is often recorded with greater dynamic range.

SUMMARY

An embodiment of the invention is a production or distribution system (e.g., a server system) that produces DRC gain values which are part of metadata of an encoded, digital audio content (or audio recording) file. For example, the DRC gain values may be positive (boost) or negative (attenuation), and are to be applied to the audio recording during playback (e.g., after the audio recording has been extracted by a decoder from the encoded file) in order to adjust a loud portion and/or a soft portion of the recording during playback. The DRC adjustment may be updated for example in every frame of the digital audio signal. The DRC adjustment may help better suit a particular type of audio recording to a particular playback acoustic environment or listening perspective. This enables playback of DRC-adjusted audio content, where the DRC adjustment was specified at the encoding stage. The audio content file may be for example a moving picture file, e.g. an MPEG movie file, an audio-only file, e.g. an AAC file, or a file having any suitable multimedia format.

In one embodiment, a Dynamic Range Control (DRC) processor produces a sequence of encoder DRC gain values, by applying a selected one of a number of DRC characteristics, to a group of one or more of the audio channels or audio objects. The encoder DRC gain values are to be applied by a decoding system, to adjust the group of audio channels or audio objects upon decoding them from the encoded digital audio recording. A bitstream multiplexer combines a) the encoded digital audio recording with b) the sequence of encoder DRC gain values, an indication of the selected DRC characteristic, and an indication of an alternate DRC characteristic selected from the plurality of DRC characteristics, the latter as metadata associated with the encoded digital audio recording. This enables the encoding system to either mandate or allow as a decoder option, an alternate DRC (that can be applied to the decoded recording during playback).

The above construct enables the encoder to provide loudness information on the effect of having applied the alternate DRC characteristic, in addition to identifying the scenarios where the alternate DRC characteristic should be applied (instead of the "default" DRC characteristic also selected at the encoding system). Significant bit rate saving is achieved, since the gain values of the alternate DRC can be derived by the decoding system based on a single DRC gain sequence that is received in the metadata. This avoids the need for the encoding system to transmit a separate DRC gain sequence for each compression scenario. The DRC gain sequence, especially when it changes on a per frame basis, may be considered to be the most bit-rate consuming portion of the metadata.

In another embodiment, the metadata is defined as having a format in which two or more sequences of encoder DRC gain values can be included by the production or distribution system (encoding system). In addition, the metadata is defined to allow instructions to be included therein, which are instructions to a decoding system from the encoding system, wherein the metadata can contain instructions in which the encoding system can specify that any one of the sequences of encoder DRC gain values (present in the metadata) can be applied to DRC-adjust any sub-band of the decoded digital audio recording. For example, metadata can specify that each of the sequences of encoder DRC gain values (that are in the metadata) is to be applied to a different sub-band of the decoded digital audio recording. In other words, the metadata may allow an arbitrary assignment of the two or more DRC gain sequences that may be included within the metadata, to arbitrarily selected ones of the sub-bands in which compression is performed by the decoding system on a sub-band basis. Once again, bit rate savings is achieved because, for example, the same DRC gain sequence can be used by the decoding system for compressing multiple sub-bands.

In yet another embodiment, in addition to the ability to arbitrarily assign a single DRC gain sequence to two or more sub-bands, the metadata also supports formatting that allows the production or distribution system to specify in the metadata that a first sub-band is to be adjusted by scaling one of the DRC gain sequences according to one scaling factor, while scaling the DRC gain sequence in accordance with another scaling factor and applying the latter to a different sub-band. This results in the decoding system, pursuant to instructions in the metadata, scaling a specified one of the DRC gain sequences by a first scaling factor (before applying that scaled sequence to a first sub-band), and scaling the specified DRC gain sequence by a second scaling factor (before applying that scaled sequence to a different sub-band), all as specified in the metadata.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements shown in a figure may be required for a given embodiment.

DETAILED DESCRIPTION

Various embodiments of the invention are described and illustrated in the figures here, including examples of relevant components of a system for producing an encoded digital audio recording, and a decoder system for applying DRC to adjust the decoded recording, during playback. The presence of numerous details concerning the metadata, including their format and their usage in the decoder system should be noted, some of which may not be required when practicing certain embodiments of the invention. Many of the details are considered to be examples of the language used in the claims below.

In some instances, well-known circuits, structures, and techniques have not been shown in detail so as not to obscure the understanding of this description. For example, certain details are described here in the context of encoding for bit-rate reduction in accordance with MPEG standards; however, the approaches for embedding DRC gain values and related information in the metadata of an encoded audio content file are also applicable to other forms of audio coding and decoding including lossless data compression, such as Apple Lossless Audio Codec (ALAC).

Figure 1:
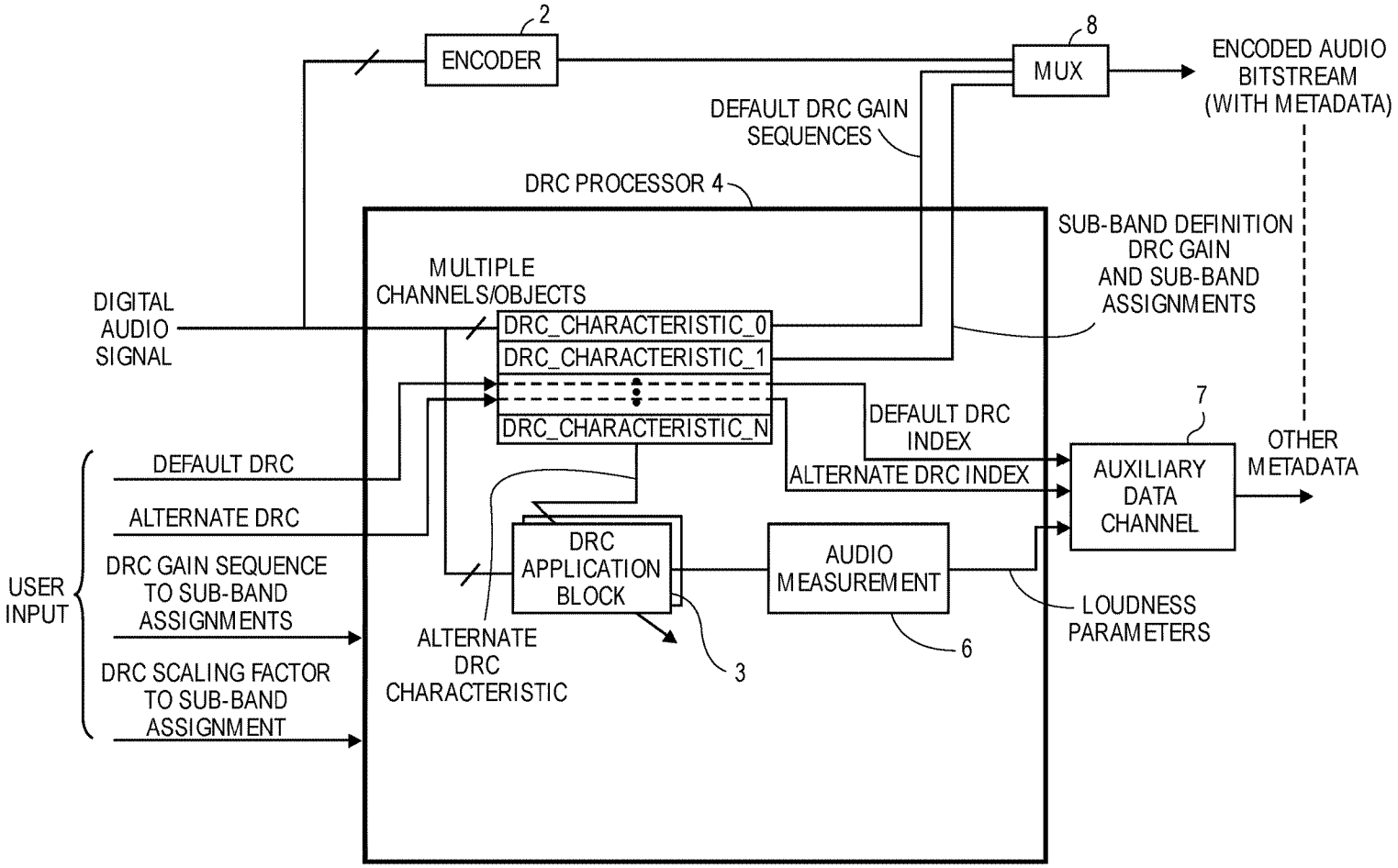
FIG. 1 is a block diagram that is used to illustrate aspects of a digital audio encoding system.

FIG. 1 is a block diagram that is used to illustrate aspects of a digital audio encoding system. The original audio recording or audio signal in FIG. 1 may be in the form of a bitstream or file (where these terms are used interchangeably here) of a piece of sound program content, such as a musical work or an audio-visual work, e.g., the sound track of a movie that has a number of audio channels; alternatively, or in addition to the audio channels, the recording may include a number of audio objects, e.g., the sound program content of individual musical instruments, vocals, sound effects. The encoder stage processing may be performed by, for example, a computer (or computer network) of a sound program content producer or distributer, such as a producer of musical performances or movies; the decode stage processing (see FIG. 3 below) may be performed by, for example, a computer (or computer network) of a consumer, e.g. a home audio system, a speaker dock, an audio system in a vehicle. The block diagram is used to describe not only a digital audio encoder apparatus, but also a method for encoding an audio signal.

The encoding system has an encoder 2 which encodes a digital audio recording (or also referred to here as a digital audio signal), that has a number of original audio channels or audio objects (indicated in the figures here by the forward slash across the lines representing signal flow), into a different digital format. The new format may be more suitable for storage of an encoded file (e.g., on a portable data storage device, such as a compact disc or a digital video disc), or for transmitting a bitstream to a consumer's computer (e.g., over the Internet). The encoder 2 may also perform lossy or lossless bitrate reduction (data compression), upon the original audio channels or audio objects, e.g., in accordance with MPEG standards, or lossless data compression such as Apple Lossless Audio Codec (ALAC).

The encode stage processing may also have a multiplexer (mux) 8 that combines or assembles the encoded digital audio recording with one or more sequences of DRC gain values, the latter as metadata associated with the encoded digital audio recording. The result of the combination may be a bitstream or encoded file (generically referred to from now on as "a bitstream") that contains the encoded recording and its associated metadata. It should be noted that the metadata may be embedded with the encoded recording in the bitstream, or it may be provided in a separate file or side channel, generically referred to here as an auxiliary data channel 7 (with which the encoded recording is associated). The metadata associated with the encoded digital audio recording may be carried in a number of extension fields of ISO/IEC 23003-4:2015—Information Technology—MPEG audio technologies—Part 4: Dynamic Range Control ("MPEG-D DRC").

The encoding stage also has a DRC processor 4 that produces the sequences of encoder DRC gain values. A default DRC gain sequence is produced by applying a selected one of a number of DRC characteristics or profiles (where there are at least two, or N, that may be stored in the DRC processor 4) to a group of one or more of the audio channels or audio objects that are part of the digital audio signal. This may be repeated to result in multiple DRC gain sequences being produced, corresponding to multiple groups of audio channels or objects. A DRC characteristic or profile may be stored within memory as part of the DRC processor 4 and also as part of the DRC_1 processor 12 in the decoding system—see FIG. 3. Examples of DRC characteristics are given in FIG. 2, where the input level along the x-axis refers to a short-term loudness value (also referred to here as DRC input level), while a range of DRC gain values are given along the y-axis.

The default DRC characteristic may be selected by a user, via user input (e.g. a graphical user interface). The user may be a mixing or sound engineer that evaluates the type of content in the relevant channel or object, including for example listening to the channel or object through playback equipment (not shown), and makes the selection based on experience, the type of content, and how the channel or object would sound when its dynamic range has been modified (according to the default characteristic) in an acoustic setting or in a particular playback device scenario (e.g. headset versus built-in speakers of a laptop or desktop computer versus stand alone loudspeakers). This may be done in order to modify, for example, a movie soundtrack to be played back through an audio system that may have less dynamic range than the audio system of a public movie theater.

Figure 2:
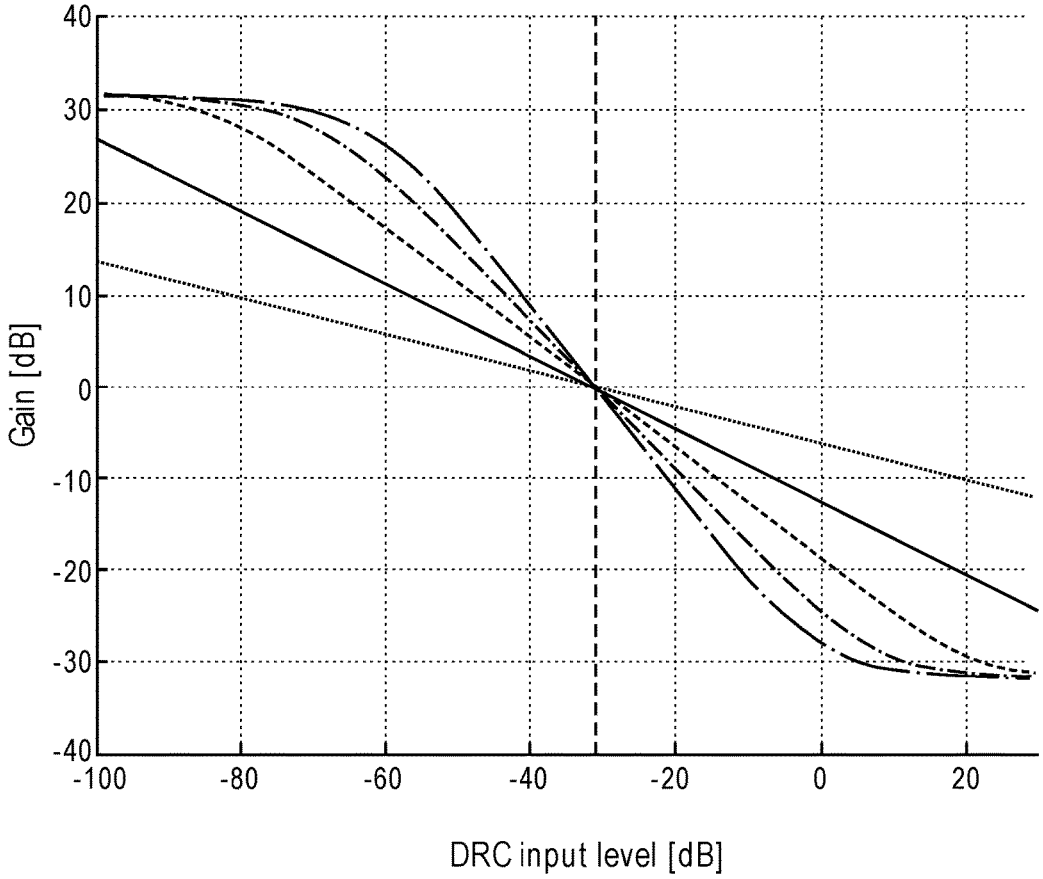
FIG. 2 shows several example dynamic range control (DRC) characteristics.

For a given DRC input level, the characteristic yields a corresponding gain value that is positive (expansive effect) or negative (compressive effect) and that is to be applied to the input audio signal, by a DRC application block 3—see FIG. 1. In other words, the DRC block 3 is said to be configured with a selected DRC characteristic so that it computes any needed input level from the input audio signal, obtains an output gain by applying the input level to the characteristic, an applies the output gain to the input audio signal to perform the dynamic range adjustment. The gain values in the graph of FIG. 2 are also referred to here as DRC gain values which in this particular example are given in the logarithmic format (dB). The level of the input audio signal that is applied to the characteristic (DRC input level) may be computed over a predetermined time interval of the input audio signal, also referred to here as a frame, for example on the order of less than 5 milliseconds, e.g. less than 1 millisecond. Thus, a DRC gain sequence may provide updated DRC gain values on such a per-frame basis. Note, that the digital audio signal that is being encoded may be either in a pulse code modulated (PCM) format or in a packet-based format in which frames or chunks of the audio signal become available sequentially where each frame or chunk may be, for example, between 20-100 milliseconds long, so that several DRC gain values in sequence are applied to each audio frame or chunk. These numbers of course are examples only, such that it should be understood that the concepts applied here are not limited to the frame length defined for each gain value in a DRC gain sequence or for digitally processing an audio signal.

The gain values produced by applying the input audio signal to a selected, default DRC characteristic (by the DRC processor 4 in the encoding system) should be applied to adjust a group of one or more channels or audio objects, upon decoding the latter from the encoded digital audio recording (in the decoding system). That may be part of processing during playback as described further below in FIG. 3. To achieve this goal, the encoding stage also has some means for providing, as metadata associated with the encoded digital audio recording, the sequence of encoder DRC gain values to the decoding system. This was described above, for example as the multiplexer 8 by itself, or in combination with the auxiliary data channel 7.

In one embodiment, the metadata also includes an indication of the default DRC characteristic, as well as an indication of an alternate DRC characteristic that has been selected from the available DRC_characteristic_0, 1, . . . N. As described below, this enables the compression strength of the dynamic range control that is applied in the decoding system to be modified as dictated by user input in the encoding stage. The techniques that enable this to take place are bit-rate efficient in that new dynamic range control options are given to the decoding system without requiring the metadata to bear additional DRC gain sequences (beyond a single, default DRC gain sequence). A relatively general modification is thus available to the decoding system for performing a gain mapping of the default DRC gain sequence using knowledge of the alternate DRC characteristic that has been specified in the metadata. The metadata is now enhanced by defining additional fields in which the alternate DRC characteristic may be indicated, in addition to, for example, identifying the particular scenario or condition in which the decoding system is to apply dynamic range control in accordance with the alternate DRC characteristic (rather than the default DRC characteristic). This gain mapping of the default DRC gain sequence is described below in connection with FIG. 3.

Still referring to FIG. 1, in one embodiment, loudness parameters, or also referred to here as loudness information, can be computed by the DRC processor 4 and in particular by a loudness measurement block 6 (loudness calculator), and where these may also be included in the metadata. These loudness parameters give a measure of loudness of the alternate DRC-adjusted version of the digital audio recording, which is useful for the decoding system to evaluate when given a choice as to whether or not to apply DRC, as between the default and alternate DRC. The input to the audio measurement block 6 receives the alternate DRC-adjusted version of the input audio signal, which is provided by a DRC application block 3, where the latter has been configured in accordance with the alternate DRC characteristic (that may have been selected via user input).

Any one of several approaches may be taken for providing the "indication" of the default or alternate DRC characteristic (within the metadata). As shown in FIG. 1, the particular example there uses an index, which is a reference or pointer, to a predetermined curve or plot of input level or loudness versus output DRC gain. The curve or plot may be stored in the decoding system as DRC_characteristic_0, 1, . . . N in the memory of the DRC_1_processor 12. The decoding system will then retrieve the DRC characteristic that has been specified by the index received in the metadata. Alternatively, the metadata may indicate a DRC characteristic by containing a number of constants or parameters or coefficients that, when inserted by the decoding system into a predefined mathematical function, yield a particular loudness versus DRC gain curve. In another embodiment, the indication of a DRC characteristic may be a look-up table of all of the input level or loudness values and corresponding DRC gain values that define a DRC gain curve. Lastly, the indication of a DRC characteristic may be a reduced number of loudness values and corresponding DRC gain values from which the decoding system interpolates the DRC gain curve or a particular DRC gain value for an unspecified input loudness level (that is unspecified in the metadata). For bitrate efficiency, the indications of the DRC characteristics should be merely indices to predetermined loudness versus DRC gain curves or plots (that are stored in the decoding system).

Figure 3:
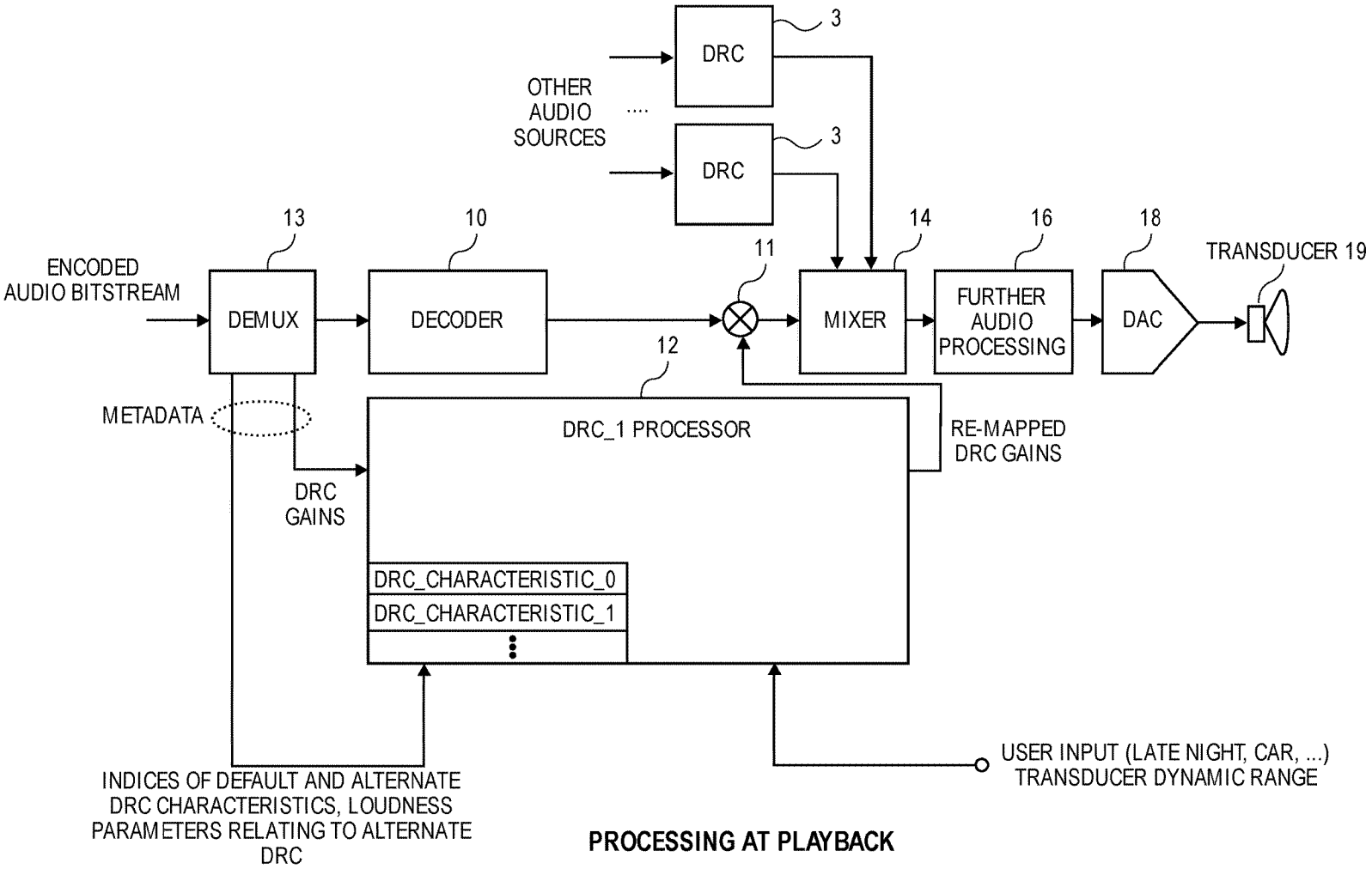
FIG. 3 is a block diagram that is used to illustrate aspects of a digital audio decoding system and in particular one in which the data processing is performed during playback of the decoded audio signal.

Having described how the metadata may be populated in the encoding system, use of the metadata while processing for playback is now described using the example of FIG. 3. FIG. 3 is a block diagram that is used to illustrate aspects of a decoding system and in particular one in which the data processing is performed during playback of the decoded audio signal. This is a system for producing a decoded digital audio recording in which a bitstream is received in which a digital audio recording has been encoded (see FIG. 1). The digital signal processing operations described here for the components shown in FIG. 3 may be implemented by dedicated hardware (circuitry), or they may be implemented by a combination of hardware circuitry and one or more programmed processors in which memory has stored therein instructions that when executed by one or more processors (generically referred to here as "a processor") perform the operations described here. In particular, a de-multiplexer (demux) 13 receives the encoded audio bitstream and extracts the encoded, multi-channel or multi-object audio which is fed to a decoder 10, while the extracted metadata is provided to a DRC_1 processor 12. In one embodiment, the metadata includes a sequence of encoder DRC gain values (DRC gains, as shown in FIG. 3) which may be the default DRC gain values mentioned above in FIG. 1. The metadata also includes an indication of a selected DRC characteristic (default DRC characteristic) which was used to derive the sequence of default DRC gain values by the encoder system (when applying the original digital audio recording to the selected or default DRC characteristic). In addition, an indication of an alternate DRC characteristic is also received in the metadata. It should be understood that some or all of the metadata may be in a separate channel than the encoded audio bitstream, e.g. the auxiliary data channel 7—See FIG. 1.

The decoder 10 will decode the digital audio recording (e.g. undo or perform the inverse of the operations performed by the encoder 2 of FIG. 1), and then playback of the decoded recording is performed starting with a multiplier block 11 which applies either the default DRC gain values to the decoded audio signal or a re-mapped set of DRC gains, to produce a dynamic range-adjusted (DRC-adjusted) audio recording. The DRC-adjusted audio signals may then be subjected to further audio processing 16 (e.g. down mix) before being converted to an analog form (by a digital to analog converter, DAC, 18) and then fed to a speaker driver input of an electro-acoustic transducer 19.

The alternate sequence of DRC gain values, also referred to as the re-mapped DRC gains in FIG. 3, may be computed by the DRC_1 processor 12 performing the following process. First, an inverse of the default DRC characteristic is produced, using the indication of the default DRC characteristic that's received in the metadata. For example, the metadata may include the index of the default DRC characteristic. This index may be used to look up the default DRC characteristic which may be stored in the DRC_1 processor 12 as shown (as one of DRC_characteristic_0, 1, . . . N). The inverse may be obtained by, for example, reversing the input and output variables of a mathematical function (DRC gain curve) that represents the DRC characteristic, and applying the sequence of encoded DRC gain values received in the metadata to the "output" of the mathematical function (or as input to a computed inverse of the mathematical function) to produce a corresponding sequence of loudness values, on a per DRC frame basis.

The process continues with obtaining an alternate DRC characteristic, using the indication received in the metadata. For example, DRC_characteristic_3 may be the default, while the alternate is indicated to be DRC_characteristic_5. The sequence of loudness values that was computed using the inverse of the default characteristic, DRC_characteristic_3, is now applied as input to the alternate characteristic, DRC_characteristic_5, to produce a sequence of DRC gain values referred to in FIG. 3 as re-mapped DRC gains or "alternate DRC gains". The re-mapped DRC gains are then applied by the multiplier block 11 to the decoded digital audio recording (coming from the output of the decoder 10) to produce an alternate DRC-adjusted version of the decoded audio recording.

The decoding system in FIG. 3 thus has the option of applying (to the output of the decoder 10) either the default DRC gain values that are received in the metadata or producing (and then applying) re-mapped gains using the procedure described above that is based on the indication of the alternate DRC characteristic (where the indication was received in the metadata). In one embodiment, the choice between those two dynamic range control adjustments may be in accordance with instructions received in the metadata. Alternatively, the choice may be made solely by the decoding system, based on user input and/or predetermined knowledge of the dynamic range of a transducer 19 that is being used for the playback. More generally, the sensitivity of the playback system including any gains applied during further audio processing 16, and the sensitivity of the digital to analog converter (DAC) 18 may also be taken into consideration when deciding between the default or the alternate DRC.

A further embodiment is also depicted in FIG. 3, where there may also be a mixer 14 that serves to combine audio signals from other audio sources that may have had separate or independent dynamic range control adjustments performed (as depicted by the separate DRC application blocks 3).

Figure 6:
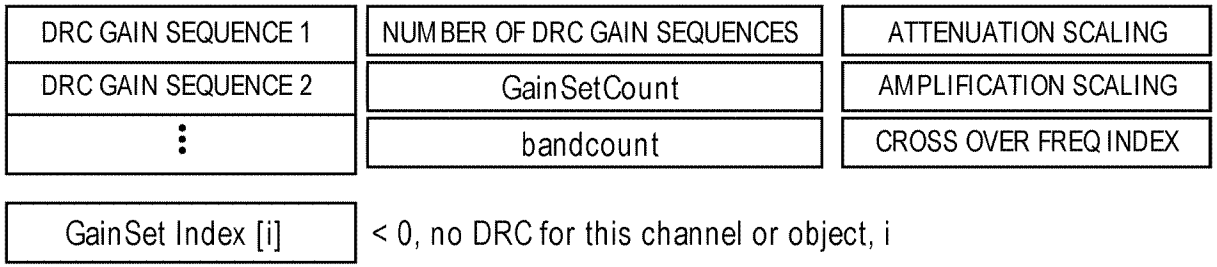
FIG. 6 depicts some example fields in the metadata that relate to DRC.

FIG. 1 and FIG. 3 as described above depict an embodiment of the invention in which a more useful DRC gain mapping feature is implemented using the metadata, by embedding the indices of both default and alternate DRC characteristics (along with optional loudness parameters relating to the alternate DRC) in the metadata. FIG. 1 and FIG. 3 also depict other embodiments of the invention in which multi-band DRC can be performed (by the multiplier block 11 of by certain internal elements of the decoder 10) upon the decoded audio signal, as specified in the metadata (by the encoding system). First, there is the ability to modify the default DRC gain values, by specifying individual, per sub-band, scaling of the default DRC gain values (by the encoding system and through instructions in the metadata). The same default DRC gain sequence can now be reused by the decoding system and applied to multiple sub-bands. Thus, referring back to FIG. 1, the DRC processor 4 now produces, in addition to a default DRC gain sequence, a sub-band definition, and a DRC gain sequence-to-sub-band assignment. The sub-band definition may be entirely conventional, for example, defining several crossover frequencies for at least two sub-bands within the overall audio spectrum. In addition, the metadata now specifies that one of the multiple sequences of encoder DRC gain values (e.g. default DRC gain sequences) that are in the metadata is to be applied to dynamic range—adjust two or more sub-bands of an audio channel or audio object that is to be decoded (from the encoded digital audio recording produced by the encoder 2). The metadata may further specify 1) a first scaling value that is to be applied to scale a specified one of the sequences of DRC gain values, before applying the scaled sequence to a first sub-band of the decoded audio channel or audio object, and 2) a second, different scaling value that is to be applied to scale the specified one of the sequences of encoder DRC gain values before applying the scaled sequence to a second sub-band of the decoded audio channel or audio object. As seen in FIG. 6, some example fields in the metadata that relate to multi-band DRC are shown. In particular, a data structure referred to as crossover frequency index may define the crossover frequencies of two or more sub-bands. The crossover frequencies are indicated together with the data structure band count, which indicates the number of sub-bands. A further data structure, multibandDRCscaling(p, band1, band2, . . . , scalar1, scalar2, . . . ) specifies which one (p=1, 2, . . . K) of the multiple (K>=2) DRC gain sequences is to be applied to adjust two or more of the sub-bands band1, band2, . . . that have been defined (are known to the decoding system), and the different scaling values scalar1, scalar2, . . . (attenuation or amplification scaling) that are to be applied to the same DRC gain sequence p before applying the scaled DRC sequence to the two or more sub-bands, respectively.

The example in FIG. 6 also illustrates the embodiment where the metadata includes an encoded DRC gain set, which is a data structure that has one or more DRC gain sequences (or sequences of encoder DRC gain values), and where there may be multiple gain sets in the metadata (as indicated in the GainSetCount data structure).

In one embodiment, the metadata specifies that one of the DRC gain sequences (in the metadata) be applied to adjust a specified two or more of the sub-bands of an audio channel or audio object (that has been decoded from the encoded digital audio recording.) The metadata may alternatively specify that the sequence of encoder DRC gain values be applied to all sub-bands of the decoded audio channel or object. In some embodiments, the metadata does not refer to any grouping of the channels or objects, so that the processor in the decoding system does not perform any grouping of audio channels or audio objects of the decoded audio recording, when performing multi-band DRC upon the decoded audio recording. For example, there may be only two audio channels that are decoded, and the same sub-band DRC should be applied to both of the channels, unless different scaling values are specified in the metadata for different sub-bands.

Figure 4:
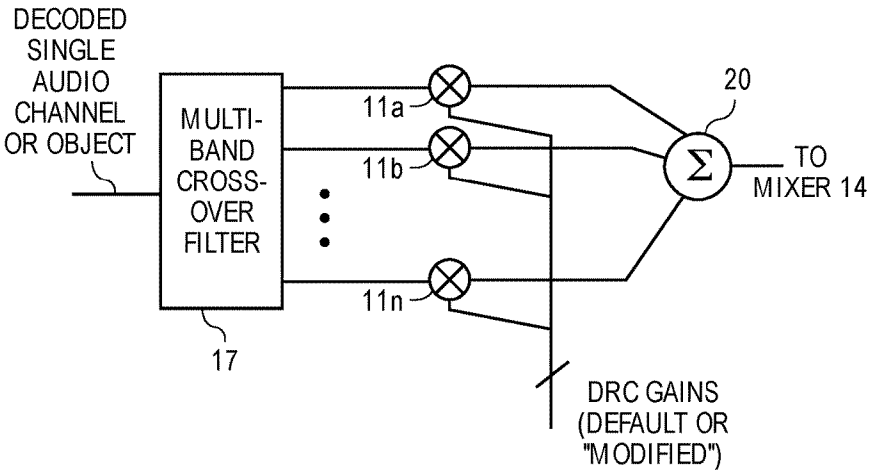
FIG. 4 is a block diagram describing aspects of an example multi-band, frequency domain DRC application block.

The application of the DRC gain values to a decoded audio signal (by a programmed processor or a combination programmed processor and hardwired logic, in the decoding system), may be in the frequency domain or in the time domain. FIG. 4 shows an example of a frequency domain implementation, in which a multi-band crossover filter 17 receives as input a decoded, single audio channel or object. The filter 17 will split its input signal into two or more constituent bands. The filter 17 may be programmed to define the bands or crossover frequencies, as specified in the metadata. The resulting sub-band signals a, b, . . . n are then fed in parallel to a number multipliers 11*a*, 11*b*, . . . 11*n*, respectively, which serve to either attenuate or amplify the sub-band signals in accordance with their associated DRC gains, respectively. The latter may be either the default values that are specified in the metadata (selected by the encoding system), or they may be "modified" values. A modified DRC gain value may be a default DRC gain that has been scaled as specified in the metadata, or it may be the result of mapping a default DRC gain through an alternate DRC characteristic as per the procedure described above. The outputs of the multipliers 11*a*, 11*b*, . . . are then summed by a summing unit 20 to yield a DRC adjusted, single audio channel or object, which is then fed to the mixer 14.

Figure 5:
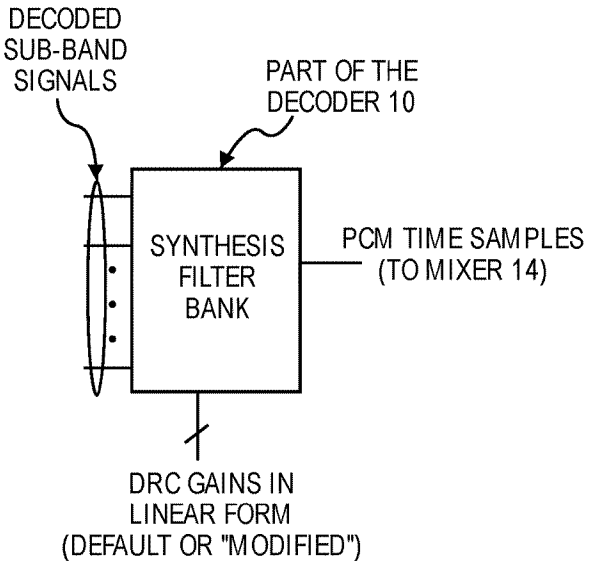
FIG. 5 is used to illustrate an example of multi-band DRC performed in the time domain as part of an audio decoder.

FIG. 5 shows an example of a time domain implementation of the application of DRC gain values. This approach may be particularly desirable when the decoder 10 (see FIG. 3) already has the decoded audio channel or object in sub-band form (where the encoding system also has knowledge of the definitions of these bands and hence can specify them in the metadata.) The decoder 10 may also have a synthesis filter bank that is used to combine the sub-band form of the decoded audio signal into a single, pulse code modulated bitstream or time sample sequence. This filter bank is dual purposed for DRC adjustment, by providing to its n scalar inputs n DRC gains (in linear form as opposed to logarithm or decibel form.) The synthesis filter bank applies the gain values at its n scalar inputs to the n sub-band signals, respectively, before combining them into a single, time domain sequence. As in the frequency domain solution, the DRC gains may be either the default values in the metadata that have been selected by the encoding system, or they may be the modified values discussed above.

It is to be understood that the embodiments described here are merely illustrative of and not restrictive on the broad invention, and that the invention is not limited to the specific constructions and arrangements shown and described, since various other modifications may occur to those of ordinary skill in the art. For example, although each of the encoding and decoding stages may be described in one embodiment as operating separately for example in an audio content producer machine and in an audio content consumer machine that are communicating over the Internet, the encoding and decoding could also be performed within the same machine (e.g., as part of a transcoding process). Thus, the description should be regarded as being illustrative, not limiting.

What is claimed is:

1. A system for producing an encoded digital audio recording having a plurality of audio channels or audio objects, comprising:

an audio encoder to encode a digital audio recording having a plurality of audio channels or audio objects;

a Dynamic Range Control (DRC) processor to produce a sequence of encoder DRC gain values by applying a selected one of a plurality of DRC characteristics to a group of one or more of the plurality of audio channels or audio objects, wherein the encoder DRC gain values are to be applied to adjust the group of audio channels or audio objects upon decoding them from the encoded digital audio recording; and means for providing as metadata associated with the encoded digital audio recording i) the sequence of encoder DRC gain values, ii) an indication of the selected DRC characteristic, and iii) an indication of an alternate DRC characteristic selected from the plurality of DRC characteristics.

2. The system of claim 1 wherein the metadata specifies a scenario or condition in which a decoding system is to apply DRC in accordance with the alternate DRC characteristic rather than the selected DRC characteristic.

3. The system of claim 1 wherein the metadata associated with the encoded digital audio recording is carried in a plurality of extension fields of MPEG-D DRC.

4. The system of claim 1 wherein the DRC processor is to receive the digital audio recording as input, and apply the input to a DRC application block that has been configured in accordance with the alternate DRC characteristic, to produce an alternate DRC-adjusted version of the digital audio recording, wherein the system further comprises a loudness calculator to compute loudness information that gives a measure of loudness of the alternate DRC-adjusted version of the digital audio recording, and wherein the means for providing as metadata associated with the encoded digital audio recoding includes the loudness information, for the alternate DRC-adjusted version, as part of the metadata.

5. The system of claim 1 wherein in the metadata, the indication of the alternate DRC characteristic comprises one of a) an index or reference to a predetermined loudness vs. DRC gain curve or plot that is stored in a decoding system, b) a plurality of constants or parameters that when inserted by the decoding system into a predefined mathematical function define a loudness vs. DRC gain curve, c) a look up table of loudness and corresponding DRC gain values, or d) a plurality of loudness and corresponding DRC gain values from which the decoding system interpolates a DRC gain value for an input loudness level.

6. The system of claim 1 wherein the DRC processor is to produce an encoder DRC gain set having a plurality of sequences of encoder DRC gain values, and wherein the means for providing as metadata associated with the encoded digital audio recording also includes the encoded DRC gain set as part of the metadata, and wherein the metadata specifies that one of the plurality of sequences of encoder DRC gain values is to be applied to adjust a plurality of sub-bands of an audio channel or audio object that has been decoded from the encoded digital audio recording.

7. The system of claim 6 wherein the metadata specifies that said one of the sequences of encoder DRC gain values is to be applied to all sub-bands of the decoded digital audio recording.

8. The system of claim 6 wherein the metadata specifies that 1) a first sub-band of the decoded digital audio recording is to be DRC adjusted by one of the sequences of encoder DRC gain values, and 2) a second sub-band is to be DRC adjusted by another one of the plurality of sequences of encoder DRC gain values.

9. The system of claim 6 wherein the metadata specifies 1) a first scaling value that is to be applied to scale the specified one of the sequences of DRC gain values before applying the scaled sequence to a first sub-band of the decoded audio channel or audio object, and 2) a second, different scaling value that is to be applied to scale the specified one of the sequences of encoder DRC gain values before applying the scaled sequence to a second sub-band of the decoded audio channel or audio object.

10. A system for producing a decoded digital audio recording, comprising:

a processor; and memory having stored therein instructions that, when executed by the processor, cause the processor to:

receive a bitstream in which a digital audio recording has been encoded, and metadata associated with the digital audio recording, wherein the metadata includes a sequence of encoder DRC gain values, an indication of a selected DRC characteristic, wherein the sequence of encoder DRC gain values was derived based on applying the digital audio recoding to the selected DRC characteristic, and an indication of an alternate DRC characteristic, decode the digital audio recoding, and perform playback of the decoded recording by producing an alternate DRC-adjusted audio recording for playback, by a) producing an inverse of the selected DRC characteristic using the indication, received in the metadata, of the selected DRC characteristic, and applying the sequence of encoder DRC gain values, received in the metadata, as input to said inverse to produce a sequence of loudness values, b) using the indication, received in the metadata, of the alternate DRC characteristic, to obtain the alternate DRC characteristic, and applying the sequence of loudness values as input to the alternate DRC characteristic to produce an alternate sequence of DRC gain values, and c) applying the alternate sequence of DRC gain values to the decoded digital audio recording to produce an alternate DRC-adjusted version of the digital audio recording.

11. The system of claim 10 wherein the metadata includes an encoder DRC gain set, the encoder DRC gain set having a plurality of sequences of encoder DRC gain values, and wherein the metadata contains instructions in which an encoding system can specify that any one of the plurality of sequences of encoder DRC gain values can be applied to any sub-band of the decoded digital audio recording.

12. The system of claim 10 wherein the metadata includes an encoder DRC gain set, the encoder DRC gain set having a plurality of sequences of encoder DRC gain values, and wherein the metadata contains instructions to the processor to apply a specified one of the sequences of encoder DRC gain values to a plurality of sub-bands of the decoded digital audio recoding when performing multi-band DRC.

13. The system of claim 10 wherein the metadata has instructions to the processor to 1) scale the specified one of the sequences of DRC gain values by a first scaling value as specified in the metadata, before applying the scaled sequence to a first sub-band of the decoded digital audio recording, and 2) scale the specified one of the sequences of DRC gain values by a second, different scaling value as specified in the metadata, before applying the scaled sequence to a second sub-band of the decoded digital audio recording.

14. A system for producing a decoded digital audio recording, comprising:

a processor;

a memory having instructions stored therein that, when executed by the processor, cause the processor to:

receive a bitstream in which a digital audio recording has been encoded, wherein the encoded digital audio recording is associated with metadata that includes an encoder DRC gain set having a plurality of sequences of encoder DRC gain values, decode the digital audio recording, and perform multi-band DRC upon the decoded digital audio recording, wherein the metadata contains instruction to apply a specified one of the plurality of sequences of encoder DRC gain values that are in the metadata to a plurality of different sub-bands of the decoded digital audio recording, wherein the sub-bands are also specified in the metadata.

15. The system of claim 14 wherein the processor does not perform any grouping of audio channels or audio objects of the decoded audio recording, when performing multi-band DRC upon the decoded audio recording.

16. The system of claim 14 wherein the metadata specifies that said one of the sequences of encoder DRC gain values is to be applied to all of the sub-bands of the decoded digital audio recording.

17. The system of claim 14 wherein the metadata contains instructions to the processor to 1) scale the specified one of the sequences of DRC gain values by a first scaling value before applying the scaled sequence to a first sub-band, and 2) scale the specified one of the sequences of DRC gain values by a second scaling value before applying the scaled sequence to a second sub-band, wherein the first and second scaling values and the first and second sub-bands are specified in the metadata.

18. A method for producing an encoded digital audio recording, comprising:

encoding a digital audio recording that has a plurality of audio channels or audio objects;

producing a sequence of encoder DRC gain values by applying a selected one of a plurality of DRC characteristics to a group of one or more of the audio channels or audio objects, wherein the encoder DRC gain values are to be applied to adjust the group of audio channels or audio objects upon decoding them from the encoded digital audio recording; and providing as metadata associated with the encoded digital audio recording (i) the sequence of encoder DRC gain values, (ii) an indication of the selected DRC characteristic and (iii) an indication of an alternate DRC characteristic selected from a plurality of DRC characteristics.

19. The method of claim 18 further comprising:

producing an alternate DRC-adjusted version of the digital audio recording in accordance with the alternate DRC characteristic;

computing loudness information that gives a measure of loudness of the alternate DRC-adjusted version of the digital audio recording; and providing as part of said metadata associated with the encoded digital audio recording, the loudness information for the alternate DRC-adjusted version.

20. The method of claim 18 further comprising providing as part of said metadata associated with the encoded digital audio recording, an instruction that the same sequence of encoder DRC gain values is to be applied by a decoding system to adjust a plurality of sub-bands of an audio channel or audio object that has been decoded from the encoded digital audio recording.

21. The method of claim 20 further comprising providing as part of said metadata associated with the encoded digital audio recording, 1) a first scaling value and instruction to apply the first scaling value to scale the specified one of the sequences of DRC gain values before applying the scaled sequence to a first sub-band of the decoded audio channel or audio object, and 2) a second, different scaling value and instruction to apply the second scaling value to scale the specified one of the sequences of encoder DRC gain values before applying the scaled sequence to a second sub-band of the decoded audio channel or audio object.

* * * * *